United States Patent [19]

Luzzatto

[11] 4,185,062

[45] Jan. 22, 1980

[54] PROCESS FOR HIGH SPEED PRODUCTION OF PRE-ORIENTED YARNS

[75] Inventor: Ettore Luzzatto, Ashqelon, Israel

[73] Assignee: Snia Viscosa Societa Nazionale Industria Applicazioni Viscosa s.p.a., Milan, Italy

[21] Appl. No.: 880,487

[22] Filed: Feb. 23, 1978

[30] Foreign Application Priority Data

Feb. 23, 1977 [CH] Switzerland ..... 2272/77

[51] Int. Cl.[2] ..... D01D 5/08

[52] U.S. Cl. ..... 264/176 F; 264/210.4

[58] Field of Search ..... 264/176 F, 210 F

[56] References Cited

U.S. PATENT DOCUMENTS

| | | | |
|---|---|---|---|
| 3,423,266 | 1/1969 | Davies et al. | 264/210 F |
| 3,481,588 | 12/1969 | Davies et al. | 264/210 F |
| 3,486,318 | 12/1969 | Cannon et al. | 264/210 F |
| 3,706,826 | 12/1972 | Bremner et al. | 264/176 F |
| 3,939,639 | 2/1976 | Ellegast | 264/210 F |
| 4,017,580 | 4/1977 | Barbes | 264/210 F |
| 4,058,385 | 11/1977 | Klerst | 264/210 F |

FOREIGN PATENT DOCUMENTS

| | | | |
|---|---|---|---|
| 2360854 | 10/1975 | Fed. Rep. of Germany | 264/210 F |
| 46-34373 | 10/1971 | Japan | 264/176 F |
| 47-21608 | 6/1972 | Japan | 264/210 F |
| 47-24168 | 7/1972 | Japan | 264/210 F |
| 47-16714 | 9/1972 | Japan | 264/210 F |
| 47-36225 | 9/1972 | Japan | 264/210 F |

*Primary Examiner*—Jay H. Woo

*Attorney, Agent, or Firm*—Wenderoth, Lind & Ponack

[57] ABSTRACT

A process for the high speed production of pre-oriented yarns from synthetic linear polymers, in particular polyesters, comprising the steps of melt spinning the polymer by extrusion through a spinneret and, before winding up the extruded filament bundle, causing said bundle to pass through a zone wherein the ambient gas, in particular air, is caused to move in a direction parallel to and concurrent with that of the filament bundle progressing towards the wind up means.

5 Claims, 2 Drawing Figures

PROCESS FOR HIGH SPEED PRODUCTION OF PRE-ORIENTED YARNS

BACKGROUND OF INVENTION

The present invention relates to a process for the high speed production of pre-oriented yarns from synthetic linear polymers, in particular polyesters but others as well, as for instance polyamides.

It is known in the art to produce partially oriented, generally called "pre-oriented", yarns which are used as raw material for further textile processing by, melt spinning and winding-up at a relatively high speed. For instance, in Belgian Pat. No. 787,882 there is described a process for preparing a texturized yarn, in which a feed yarn is employed which is constituted by a polyester yarn spun with a wind-up speed between 2560 and 4100 meters per minute (hereinafter expressed as m/1'). In this process the yarn must be wound-up at a speed which exceeds a certain minimum in order to obtain a significant and desired degree of pre-orientation, but on the other hand, it cannot be wound-up at a speed that exceeds a certain maximum, because otherwise, the orientation would be excessively pronounced and practically complete, and the yarn would not be equally suitable for the successive textile treatments, as for instance texturization.

It is evident that it is technically desirable to carry out any process at the highest possible speed in order to increase the productivity of the available equipment. On the other hand, it is possible to build, without excessive difficulties, yarn winding-up groups which operate at winding-up speeds significantly higher than the 4100 m/1' indicated as a maximum in the aforesaid patent.

Finally, if it is desired to submit the yarn obtained to further treatments, for instance texturization and drawing as in the aforesaid patent, the characteristics of the yarn cannot be varied as desired according to the winding-up speed, but must be maintained substantially unchanged if the final use is the same.

SUMMARY OF THE INVENTION

An object of the present invention is a process for the preparation of pre-oriented yarns, from synthetic linear polymers, at a very high speed and therefore with a correspondingly high productivity, whereby yarns are obtained having any desired pre-orientation degree, even pre-orientation degrees for which, according to the prior art, it is necessary to employ speeds lower than those contemplated by the present invention.

In particular, an object of the present invention is a process for obtaining a pre-oriented polyester yarn having substantially the same characteristics of the yarn according to the aforesaid Belgian Pat. No. 787,882, or at least analogous characteristics, by spinning with a winding-up speed much higher than 4100 m/1'.

The invention is characterized in that the filaments extruded from a spinneret, according to the known melt spinning process, are fed forward through a space in which the ambient gas, in particular air, is fed forward in the same direction as the yarn, and a significant speed is imparted to the gas parallel to the direction of travel of the yarn, whereafter the yarn is mechanically collected by winding up at the desired speed. In particular, to obtain yarns of any desired characteristics, the speed imparted to the ambient gas, in particular air, at least in the zone immediately adjacent the yarn, is substantially equal to the difference between the actual wind-up speed and the wind-up speed which according to the prior art operating in an uncontrolled atmosphere, provided the desired characteristics of the yarn.

By "uncontrolled atmosphere" is meant an atmosphere of a space wherein, at least in the vicinity of the yarn, the speed of the ambient gas, or more correctly, its component in the direction of travel of the yarn, is determined only by the entraining of the yarn, and no autonomous speed is imparted to said gas, so that if the yarn should stop, the component of the gas speed parallel to the yarn would be negligible. This is the situation obtained in normal spinning in which the yarn is wound-up by mechanical winding means.

BRIEF DESCRIPTION OF THE DRAWINGS

The invention will be better understood from the description of a preferred example, with reference to the attached drawings in which.

DETAILED DESCRIPTION OF THE PREFERRED EMBODIMENT

Figure 1:
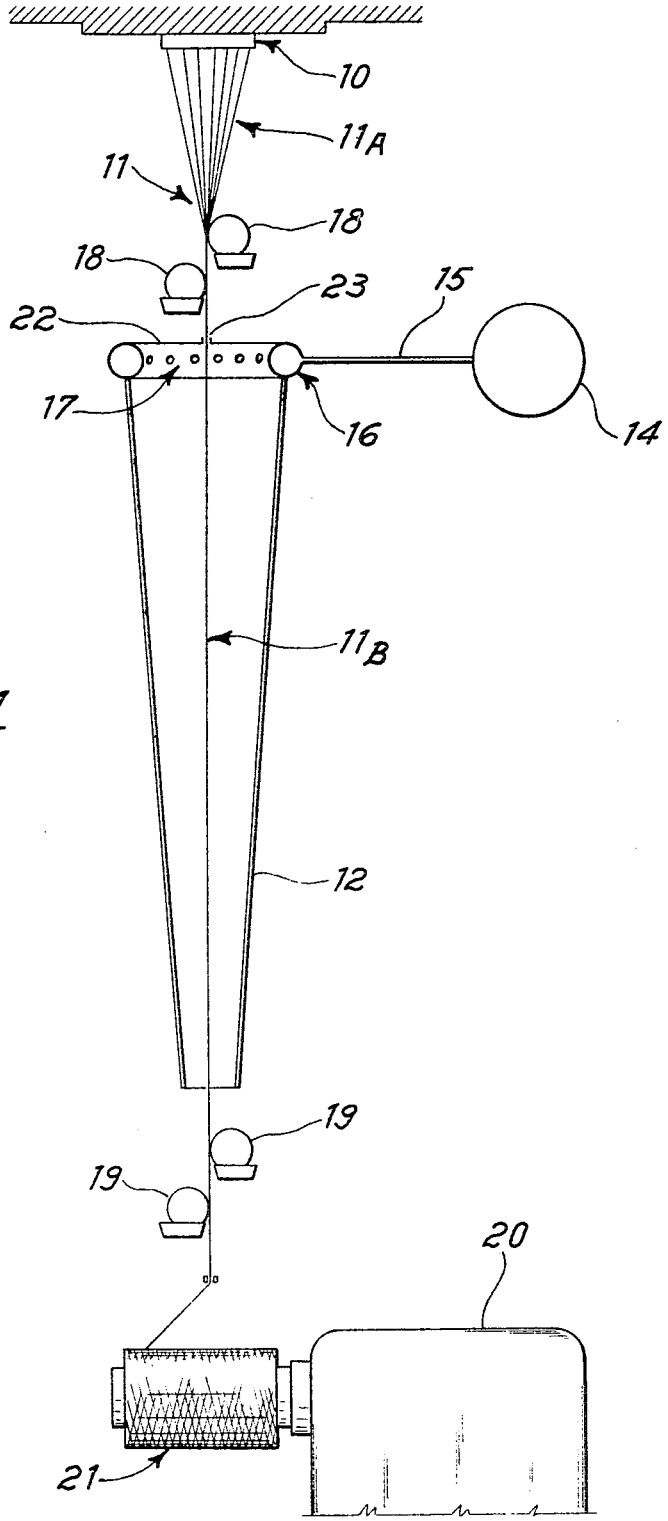
FIG. 1 schematically represents an apparatus for carrying out the invention.

With reference now to FIG. 1, numeral 10 diagrammatically indicates a spinneret from which the polymer, in particular the polyester, employed for the carrying out of the invention, is extruded. The spinneret may have any desired number of orifices, correspondingly producing a filament bundle 11 having any desired number of filaments, and the orifices need not necessarily have diameters which differ from those employed in the known art. The flow rate of polymer melt through the spinneret orifices is easily calculable from the wind-up speed and the count of the yarn that it is desired to obtain, and will have to be such as to furnish the quantity of polymer that is necessary to collect a yarn of the desired count at the wind-up speed employed.

Below the spinneret the yarn 11 comprises a zone 11-A in which it solidifies and in which it may be optionally subjected to a cooling action using cold gaseous streams, which are not illustrated because they have no direct relationship to the invention.

Below zone 11-A, the yarn runs along the zone 11-B in a guide channel 12. In the channel an air stream, or even a stream of a different gas, is caused to flow in the same stream direction as the yarn. The air may be at room temperature, or may be heated, according to the polymer employed and the characteristics desired from the yarn, and according to what appears suitable in each different case; the temperature is not a critical feature in carrying out the invention.

The concurrent motion of the ambient gas may be determined in any desired way. Only for illustrative purposes it is assumed in the drawing that the ambient gas is fed in by a pump 14 through a pipe 15 which blends with an annular space 16 from which the air, through a plurality of holes 17, radially enters into the accompanying tube 12. A plate, schematically indicated at 22 closes said tube 12 at the top, leaving an aperture 23 for the passage of the yarn; said aperture 23 is narrow enough for the entraining effect of the yarn to prevent the air from leaking out of it.

In the illustrated example tube 12 has a cross-section which decreases from top to bottom, which is better to regulate the axial air flow and gradually to increase the speed of the air in a zone in which, because of the drawing effect, the actual speed of the yarn increases; but the tube may have any cross-section that may be found suitable.

Above the entrance of the accompanying tube 12 finish may be applied by any suitable device, schematically indicated as a couple of rollers 18, or an analogous device, indicated by 19, may be located at the outlet of accompanying tube 12, or finally both devices or any other known devices may be employed to lubricate the yarn. It is also acceptable that a finish may be applied inside the accompanying tube 12 by means of devices easily conceivable by persons skilled in the art.

As it leaves the accompanying tube 12, the yarn is drawn by a drawing device generally indicated at 20 and proceeds to form a bobbin 21. The wind-up speed is maintained uniform, as is normal in devices of this kind.

Let us suppose now to start from a polyester yarn constituted by polyethyleneterephthalate having a relative viscosity in phenoltetrachloroethane equal, for instance, to about 22. Operating according to the prior art, if it is desired to obtain a pre-oriented yarn having an elongation at break of about 140%, it is necessary to operate at a wind-up speed of 3000–3100 m/1'. If the wind-up speed is increased to about 4000 m/1', the elongation at break decreases to 70–75%. Lower elongations at break do not permit an advantageous application of the concurrent drawing and texturization process.

If the air is fed to accompanying tube 12 at such a flow rate that, taking into account the cross-section of the tube, a speed of flow of about 1000 m/1' in the same direction of the yarn is imparted to the air in the immediate vicinity of the yarn, it will be possible to operate at a wind-up speed of about 4000 m/1' and still have an elongation at break of about 140%. If an elongation at break of 70–75% is sufficient, with the same speed imparted to the air, it will be possible to increase the wind-up speed up to about 5000 m/1'.

It will be necessary to specify that by "speed imparted to the air" is understood in the description and in the claims, the speed, measured in the direction of the yarn axis, that would be reached by the air in the absence of any entraining by the yarn and while aperture 23 is closed, which speed is different from that reached by the air while the yarn is in motion, and it is possible to measure said speed before starting the spinning or by subsequently stopping the yarn. When the tube 12 does not have a constant cross-section, the actual speed changes from cross-section to cross-section and it is then necessary to refer to the maximum speed which is generally the one measured adjacent to the outlet cross-section of the yarn, that is at the bottom. The air speed is always understood to be measured in the vicinity of the yarn, even though the outlet cross-section will be generally small enough to permit practical reference to the average speed.

Figure 2:
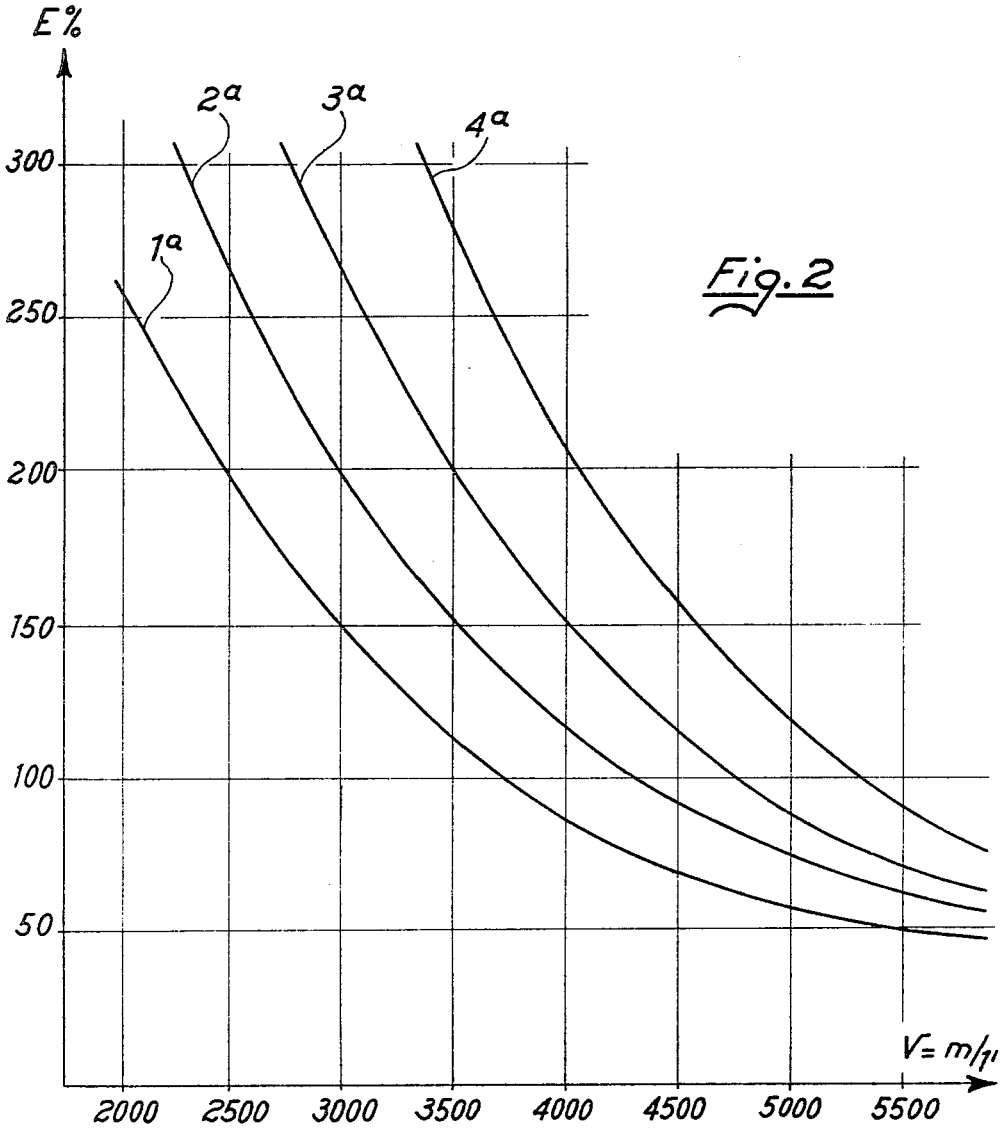
FIG. 2 represents a diagram which illustrates the effects and the results of the invention, comparing the characteristics of the yarn obtained according to the invention with those of a yarn obtained according to the prior art.

The aforesaid relationships are clearly illustrated in FIG. 2. The curves refer to a final count of 150 dtex. Said figure represents a diagram in which the wind-up speeds (V in m/1') are marked in the abscissae and in the ordinate the percent elongation at break (E%) of the resulting pre-oriented yarn, which may be considered as a measure of the pre-orientation degree, and to which the outer characteristics of the yarn are anyway strictly coordinated. Curve $1^a$ refers to a yarn produced under normal conditions, that is without applying the invention, and for instance as described in the aforesaid Belgian Patent No. 787,882. Curves $2^a$, $3^a$, and $4^a$ represent in an analogous way the behavior of yarns which have been spun into an accompanying tube in which a speed—measured and understood as hereinbefore defined—was imparted to the air, respectively of 500, 1000, and 1500 m/1'.

It is easy to note that the same characteristics of the finished yarn are obtained at progressively increasing wind-up speeds, from curve to curve, and thus a corresponding productivity increase is obtained.

The following Table illustrates some specific embodiments of the invention, together with comparison examples.

The quantitative parameters reported are defined in the Table, which therefore requires no further explanations. All the yarns to which the Table refers have a count of 70 dtex when completely drawn.

The progress provided by the invention is thus evident, and it is also evident that the invention may be carried out by a person skilled in the art with numerous modifications, variations and adaptations without exceeding its scope.

| Polymer | POLYETHYLENETEREPHTHALATE | | | | | | | | | | | |
|---|---|---|---|---|---|---|---|---|---|---|---|---|
| Relative viscosity in phenoltetrachloroethane | 1.78 | | | | 1.74 | | | | 1.78 | | | |
| Titanium dioxide | 0.4 | | | | 0.035 | | | | 0.4 | | | |
| No. of spinneret orifices | 24 | | | | 24 | | | | 32 | | | |
| Shape of orifices | circular | | | | triangular | | | | circular | | | |
| Wind-up speed m/l' | 3000 | 3500 | 4000 | 4525 | 3000 | 3580 | 3970 | 4500 | 3000 | 3550 | 4050 | 4500 |
| Count dtex of wound-up yarns | 110 | 110 | 110 | 110 | 110 | 110 | 110 | 110 | 265 | 265 | 265 | 265 |
| Elong. % of wound yarns | 106 | 106 | 106 | 106 | 115 | 115 | 115 | 115 | 135 | 135 | 135 | 135 |
| Load at break of | 280 | 280 | 280 | 280 | 250 | 250 | 250 | 250 | 620 | 620 | 620 | 620 |
| Speed imparted to air in m/l' | — | 500 | 1000 | 1500 | — | 500 | 1000 | 1500 | — | 500 | 1000 | 1500 |
| Example No. | comp. | 1 | 2 | 3 | comp. | 4 | 5 | 6 | comp. | 7 | 8 | 9 |

I claim:

1. Process for the preparation of pre-oriented yarns from synthetic linear polymers, characterized in that a melt of the polymer is extruded from a spinneret and the extruded yarn, on its way to mechanical winding means, passes through a zone in which a speed is imparted to the ambient gas in said zone in the direction of travel of the yarn and in its vicinity, said speed of the ambient gas being substantially equal to the difference between the actual wind-up speed and the speed at which it would be necessary to wind up the yarn in order to obtain the desired mechanical characteristics thereof when operating in an uncontrolled atmosphere, the yarn being wound up by said mechanical winding means at a speed of greater than 4100 meters per minute after leaving said zone to obtain a yarn having an elongation at break of at least 70%.

2. Process according to claim 1, characterized in that the synthetic linear polymer is polyethyleneterephthalate.

3. Process according to claim 1, characterized in that the yarn is submitted to a finishing treatment before entering said zone.

4. Process according to claim 1, characterized in that said ambient gas is air.

5. Process according to claim 1, characterized in that said zone is bounded by a tube which encloses the yarn and to which the gas itself is fed at a flow rate and pressure corresponding to the desired speed of the gas in said zone.

* * * * *